US011202929B2

(12) United States Patent
Zhang et al.

(10) Patent No.: US 11,202,929 B2
(45) Date of Patent: Dec. 21, 2021

(54) FIRE ENGINE

(71) Applicant: Shandong Hongda Technology Group Co., Ltd., Jinan (CN)

(72) Inventors: Deli Zhang, Jinan (CN); Yongxing Ji, Jinan (CN); Liang Zhang, Jinan (CN); Zhankun Xie, Jinan (CN); Lei Tao, Jinan (CN); He Yang, Jinan (CN); Shengyang Duan, Jinan (CN)

(73) Assignee: SHANDONG HONGDA TECHNOLOGY GROUP CO., LTD., Jinan (CN)

( * ) Notice: Subject to any disclaimer, the term of this patent is extended or adjusted under 35 U.S.C. 154(b) by 301 days.

(21) Appl. No.: 16/521,608

(22) Filed: Jul. 25, 2019

(65) Prior Publication Data

US 2019/0381345 A1 Dec. 19, 2019

Related U.S. Application Data

(63) Continuation-in-part of application No. PCT/CN2018/000073, filed on Feb. 12, 2018.

(30) Foreign Application Priority Data

Dec. 18, 2017 (CN) ..... 201711368271.2

(51) Int. Cl.
*A62C 5/00* (2006.01)
*A62C 27/00* (2006.01)
(Continued)

(52) U.S. Cl.
CPC ..... *A62C 5/008* (2013.01); *A62C 27/00* (2013.01); *A62C 31/07* (2013.01); *A62C 31/005* (2013.01);
(Continued)

(58) Field of Classification Search
CPC ..... A62C 5/008; A62C 27/00; A62C 31/07; A62C 31/02; A62C 31/005; A62C 35/023;
(Continued)

(56) References Cited

U.S. PATENT DOCUMENTS 945,899 A * 1/1910 Achée ..... B05B 7/0416 239/398
2,630,183 A * 3/1953 Foutz ..... B01F 5/0408 169/15
(Continued)

FOREIGN PATENT DOCUMENTS

CN 105251629 A * 1/2016

*Primary Examiner* — Joseph A Greenlund
(74) *Attorney, Agent, or Firm* — Matthias Scholl P.C.; Matthias Scholl

(57) ABSTRACT

A fire engine including a vehicle frame, a liquid nitrogen storage tank, a liquid nitrogen conveying pipeline, a gasification device, a plurality of electric valves, a water pipe adapter, a liquid nitrogen spray gun, and a mixed spray gun. The liquid nitrogen conveying pipeline includes a first pipeline and a second pipeline. The first pipeline connects the lower part of the liquid nitrogen storage tank, the gasification device, and the upper part of the liquid nitrogen storage tank sequentially in that order. The second pipeline connects the liquid nitrogen storage tank, an input end of the liquid nitrogen spray gun, and a first input end of the mixed spray gun. The mixed spray gun includes a first input end, a second input end, a liquid nitrogen nozzle, and a spray pipe. The spray pipe includes a contraction section, an expansion section, and an acceleration section.

8 Claims, 5 Drawing Sheets

(51) Int. Cl.

| | |
|---|---|
| ***A62C 31/07*** | (2006.01) |
| ***A62C 31/02*** | (2006.01) |
| *A62C 31/00* | (2006.01) |
| *F17C 13/04* | (2006.01) |
| *F17C 13/08* | (2006.01) |
| *A62C 99/00* | (2010.01) |

(52) U.S. Cl.
CPC ..... *A62C 31/02* (2013.01); *A62C 99/0018* (2013.01); *F17C 13/04* (2013.01); *F17C 13/083* (2013.01); *F17C 2201/0109* (2013.01); *F17C 2205/0332* (2013.01); *F17C 2205/0352* (2013.01); *F17C 2205/0388* (2013.01); *F17C 2221/014* (2013.01); *F17C 2223/0153* (2013.01); *F17C 2270/0168* (2013.01)

(58) Field of Classification Search
CPC ..... B05B 7/0416; B05B 7/0433; B05B 7/065; B05B 7/0408; B05B 7/045
See application file for complete search history.

(56) References Cited

U.S. PATENT DOCUMENTS 3,438,445 A * 4/1969 MacCracken ..... A62C 27/00 169/44
3,531,050 A * 9/1970 Abraham ..... B05B 7/0466 239/427.3
4,300,723 A * 11/1981 Prasthofer ..... B05B 15/65 239/499
4,353,504 A * 10/1982 Girardin ..... F25C 3/04 239/14.2
4,603,810 A * 8/1986 Schleimer ..... C21C 5/32 239/1
4,645,009 A * 2/1987 Hawelka ..... B01F 5/04 169/15
4,951,713 A * 8/1990 Jordan ..... B01F 5/0405 137/115.13
5,197,548 A * 3/1993 Volker ..... A62C 31/02 169/11
5,520,331 A * 5/1996 Wolfe ..... A62C 31/02 239/398
6,666,278 B2 * 12/2003 Cicanese ..... A62C 3/02 169/30
6,834,728 B2 * 12/2004 Demole ..... A62C 3/0292 169/5
7,096,965 B2 * 8/2006 Ozment ..... A62C 5/02 169/15
7,475,831 B2 * 1/2009 Van Steenkiste ..... B05B 7/1486 118/308
8,276,680 B2 * 10/2012 Bouthiette ..... A62B 99/00 169/44
8,651,394 B2 * 2/2014 Heinrich ..... C23C 24/04 239/1
9,737,741 B1 * 8/2017 Van Lingen ..... A62C 5/02
2005/0263297 A1 * 12/2005 Dimarzo ..... A62C 5/02 169/15
2006/0153991 A1 * 7/2006 Winter ..... B05B 1/3442 427/421.1
2008/0149355 A1 * 6/2008 Joven Marco ..... A62C 27/00 169/69
2008/0217026 A1 * 9/2008 Hursey ..... A62C 5/02 169/15
2008/0245898 A1 * 10/2008 Wolfe ..... A62C 5/002 239/419
2008/0305420 A1 * 12/2008 Kinoshita ..... B05B 7/10 430/97
2010/0132961 A1 * 6/2010 Sandford ..... A62C 5/008 169/16
2010/0230119 A1 * 9/2010 Worthy ..... A62C 31/02 169/46
2012/0193108 A1 * 8/2012 Cordani ..... A62C 3/16 169/15
2013/0112439 A1 * 5/2013 Cordani ..... A62C 99/0009 169/44
2014/0001278 A1 * 1/2014 Hagquist ..... A62C 5/002 239/10
2015/0048176 A1 * 2/2015 Jones ..... A62C 5/008 239/8
2019/0344107 A1 * 11/2019 Li ..... B05B 7/1468
2019/0381345 A1 * 12/2019 Zhang ..... A62C 27/00
2020/0179882 A1 * 6/2020 Kato ..... B01F 5/043
2020/0391062 A1 * 12/2020 Miller ..... A62C 3/02

* cited by examiner

FIRE ENGINE

CROSS-REFERENCE TO RELATED APPLICATIONS

This application is a continuation-in-part of International Patent Application No. PCT/CN2018/000073 with an international filing date of Feb. 12, 2018, designating the United States, now pending, and further claims foreign priority benefits to Chinese Patent Application No. 201711368271.2 filed Dec. 18, 2017. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND

The disclosure relates to fire-fighting technology, and more particularly to a fire engine which uses liquid nitrogen as an extinguishing agent.

Conventional fire engines employ water or liquid nitrogen as an extinguishing agent. The liquid nitrogen is pressurized by a pump and then mixed with water for firefighting.

SUMMARY

The disclosure provides a fire engine with liquid nitrogen as an extinguishing agent. The fire engine can store liquid nitrogen. In use, the liquid nitrogen is gasified and then mixed with water to form an atomized jet fluid of water, water-based fire extinguishing agents and/or decontaminants. Such atomized jet fluid yields in efficient firefighting.

Disclosed is a fire engine comprising a vehicle frame, a liquid nitrogen storage tank comprising a first opening and a second opening, a liquid nitrogen conveying pipeline, a gasification device, a plurality of electric valves, a water pipe adapter, a liquid nitrogen spray gun, and a mixed spray gun. The liquid nitrogen storage tank is disposed on the vehicle frame. The second opening is disposed higher than the first opening relative to the gasification device.

The liquid nitrogen conveying pipeline comprises at least a first pipeline, a second pipeline, and a third pipeline. The first pipeline connects the first opening of the liquid nitrogen storage tank, the gasification device, and the second opening of the liquid nitrogen storage tank sequentially in that order; the second pipeline connects the liquid nitrogen storage tank, an input end of the liquid nitrogen spray gun, and a first input end of the mixed spray gun sequentially in that order. The third pipeline is provided with a safety valve and a relief valve, and the external liquid nitrogen is input to the liquid nitrogen storage tank via the third pipeline. The mixed spray gun comprises a first input end, a second input end, a liquid nitrogen nozzle and a spray pipe, and the spray pipe comprises a contraction section, an expansion section, and an acceleration section which are connected to one another in that order. Along a direction from the contraction section to the acceleration section, the inner diameter of the contraction section decreases, and the inner diameter of the expansion section increases. The inner diameter of the acceleration section is constant and equal to the outlet diameter of the expansion section. The liquid nitrogen nozzle communicates with the first input end and is disposed on the axial line of the contraction section; the outlet of the liquid nitrogen nozzle is coaxial with the outlet of the contraction section.

An inlet of the second input end is connected to a water pipe adapter and an outlet of the second input end communicates with the contraction section; the water pipe adapter is connected to the inlet of the second input end via a water delivery pipeline; the plurality of electric valves is disposed on the liquid nitrogen conveying pipeline and the water delivery pipeline.

A mixed spray gun comprises a first input end, a second input end, a liquid nitrogen nozzle and a spray pipe, and the spray pipe comprises a contraction section, an expansion section, and an acceleration section which are connected to one another in that order. Along a direction from the contraction section to the acceleration section, the inner diameter of the contraction section decreases, and the inner diameter of the expansion section increases. The inner diameter of the acceleration section is constant and equal to the outlet diameter of the expansion section. The liquid nitrogen nozzle communicates with the first input end and is disposed on the axial line of the contraction section; the outlet of the liquid nitrogen nozzle is coaxial with the outlet of the contraction section. An inlet of the second input end is connected to a water source and an outlet of the second input end communicates with the contraction section.

The gasification device comprises a gasification tube and a plurality of heat dissipating fins; the gasification tube is connected to the first pipeline, and the heat dissipating fins are radially disposed on the outer wall of the gasification tube.

The liquid nitrogen storage tank comprises a housing, a liner, and a gap between the housing and the liner; the liner is disposed in the housing. The gap is dried and has a pressure of 0.001 to 0.005 Pa, and the outer surface of the liner is provided with a heat insulating material comprising a zirconia foil layer.

The following advantages are realized:

(1) The liquid nitrogen, water, water-based fire extinguishing agent, and chemical decontaminant are mixed in the liquid nitrogen spray gun. The liquid nitrogen is gasified. The phase change expands the volume of the nitrogen, and the driving force is produced to atomize and spray the mixture of water, water fire extinguishing agent or chemical decontaminant. A relatively high velocity and large flow rate is achieved which yields in firefighting and emergency rescue. The water consumption is reduced relative to an area of fire to be extinguished.

(2) The liquid nitrogen absorbs heat in the gasification device to increase the internal pressure of the liquid nitrogen storage tank, and in the firefighting process, a small amount of liquid nitrogen is guided to the gasification device for gasification. The pressure in the liquid nitrogen storage tank can rise to 1.2 to 1.6 megapascal, and the liquid nitrogen is continuously and steadily supplied to the fire gun at this pressure.

(3) The thermal conductivity of zirconia foil is low ($1.01\times10^4$ W/m·K), and the reflectance of the zirconia foil to long wave, medium wave and infrared is as high as 85% or higher. The thermal insulation performance is superior to the traditional ultra-thin glass wool insulation material which lacks heat reflection property; the intermediate layer between the housing and the liner is dried, and then pumped to a vacuum state. This prevents heat convection exchange to the inside and outside the tank.

Figure 1:
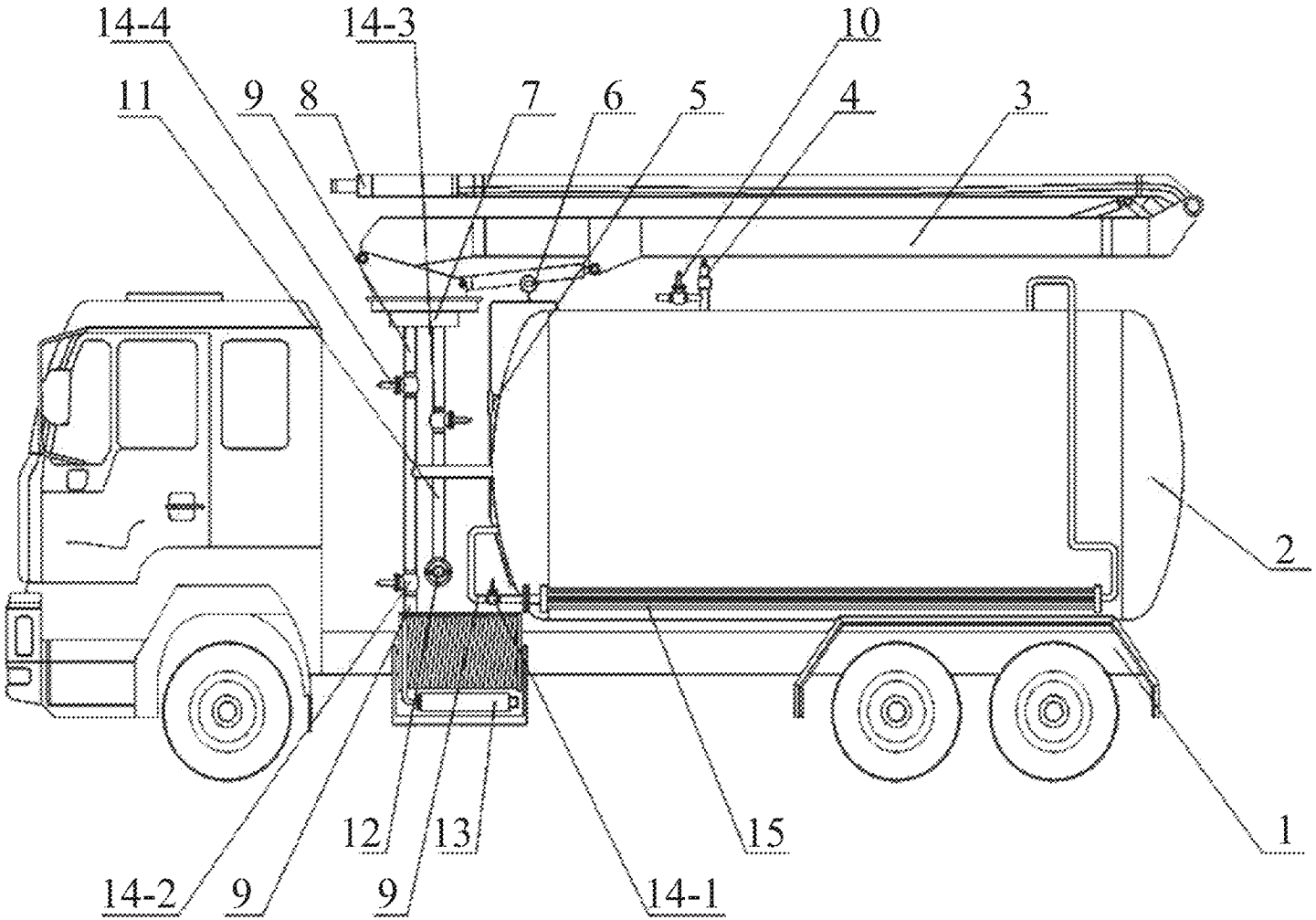
FIG. 1 is a schematic diagram of a liquid nitrogen fire engine as described in the disclosure.

In the drawings, the following reference numbers are used: 1. Vehicle frame; 2. Liquid nitrogen storage tank; 2-1. Housing; 2-2. Liner; 2-3. Heat insulating material; 3. Folding crane; 4. Safety valve; 5. Level gauge; 6. Pressure sensor; 7. Rotatable support; 8. Mixed spray gun; 8-1. Contraction section, 8-2. Expansion section; 8-3. Acceleration section; 8-4. Liquid nitrogen nozzle; 9. Liquid nitrogen conveying pipeline; 10. Relief valve; 11. Water delivery pipeline; 12. Water pipe adapter; 13. Liquid nitrogen spray gun; 14-1. First electric valve; 14-2. Second electric valve; 14-3. Third electric valve; 14-4. Fourth electric valve; 15. Gasification device; 15-1. Gasification tube; 15-2. Heat dissipating fins.

DETAILED DESCRIPTION

As shown in FIG. 1, a fire engine with liquid nitrogen as an injection power comprises a vehicle frame 1, a liquid nitrogen storage tank 2, a liquid nitrogen conveying pipeline 9, a gasification device 15, a rotatable support 7, a folding crane 3, a water delivery pipeline 11, a water pipe adapter 12, a mixed spray gun 8, a liquid nitrogen spray gun 13, and a plurality of electric valves.

Figure 2:
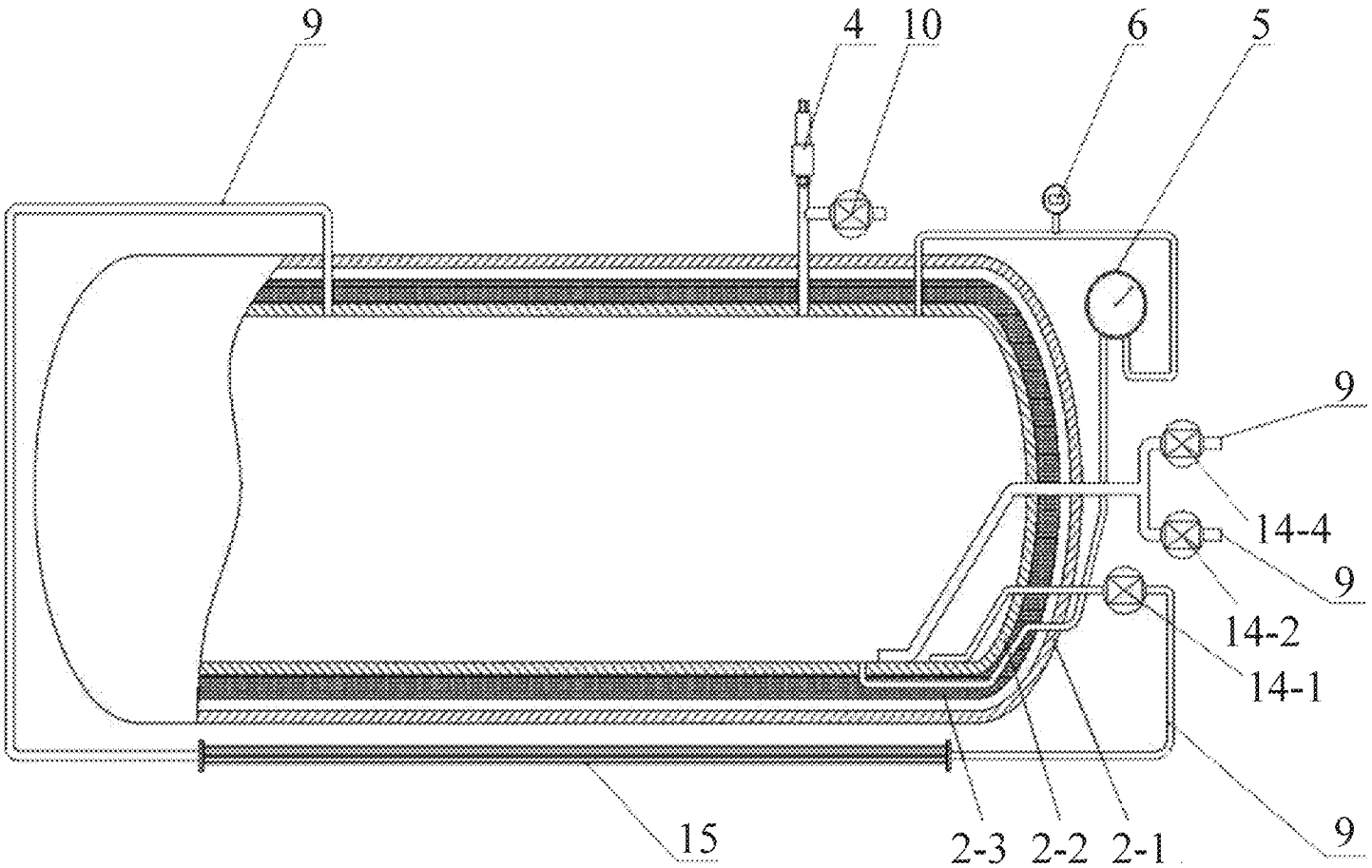
FIG. 2 is a schematic diagram of a liquid nitrogen storage tank as described in the disclosure.

As shown in FIG. 2, the liquid nitrogen storage tank 2 is disposed on the vehicle frame. The liquid nitrogen storage tank 2 comprises a steel housing 2-1, a liner 2-2, and a heat insulating material 2-3. The liner 2-2 is of a steel material and disposed in the housing 2-1. There is a gap between the housing and the liner. The heat insulating material 2-3 is wound around the outer surface of the liner. During manufacturing the liquid nitrogen storage tank 2, the insulating material 2-3 of the zirconia foil layer is wound on the outer surface of the liner 2-2. The zirconia foil has a low thermal conductivity ($1.01\times10^{-4}$ W/m·K), a reflectivity of more than 85% for long-wave, medium-wave and infrared, and its thermal insulation performance is better than glass wool which has no thermal reflectivity. The intermediate layer between the housing 2-1 and the liner 2-2 is completely dried to remove water, and evacuated to 0.001 to 0.005 Pa. The heat convection exchange inside and outside the tank is blocked by the vacuum layer. The zirconia aluminum foil with excellent heat insulation and reflectivity properties can prevent the heat radiation exchange inside and outside the tank. Thus, the tank has excellent thermal insulation properties.

As shown in FIG. 2, the liquid nitrogen storage tank 2 is provided with a safety valve 4, a level gauge 5, a pressure sensor 6, a relief valve 10, and a liquid nitrogen conveying pipeline 9. The liquid nitrogen storage tank comprises a first opening and a second opening. The second opening is disposed higher than the first opening relative to the gasification device.

The safety valve 4 is disposed above the liquid nitrogen storage tank 2 for releasing the pressure in the tank when the air pressure in the liquid nitrogen storage tank 2 is too high, so that the pressure value in the tank is maintained between 1.2 and 1.6 megapascal.

The level gauge 5 is disposed in the middle and upper part of the liquid nitrogen storage tank 2 for indicating the amount of the liquid nitrogen remaining in the liquid nitrogen storage tank 2.

The pressure sensor 6 is disposed above the liquid nitrogen storage tank 2 for measuring the gas pressure in the liquid nitrogen storage tank 2.

The relief valve 10 is disposed above the liquid nitrogen storage tank 2 for maintaining the pressure of the liquid nitrogen in the tank not more than 0.8 megapascal. When the pressure in the tank is greater than the value, the relief valve is opened to release a portion of low temperature nitrogen in the tank to reduce the pressure in the tank and achieve a long-time cryogenic storage of liquid nitrogen.

The liquid nitrogen conveying pipeline 9 is provided with three paths:

(1) The first pipeline starts from the first opening of the liquid nitrogen storage tank 2, passes through the gasification device 15, and then is connected to the second opening of the liquid nitrogen storage tank 2.

(2) The second pipeline connects the liquid nitrogen storage tank 2 and the input end of the liquid nitrogen spray gun 13 and the first input end of the mixed spray gun 8.

(3) The third pipeline connects the liquid nitrogen storage tank 2 and the safety valve 4 and the relief valve 10.

Figure 3A:
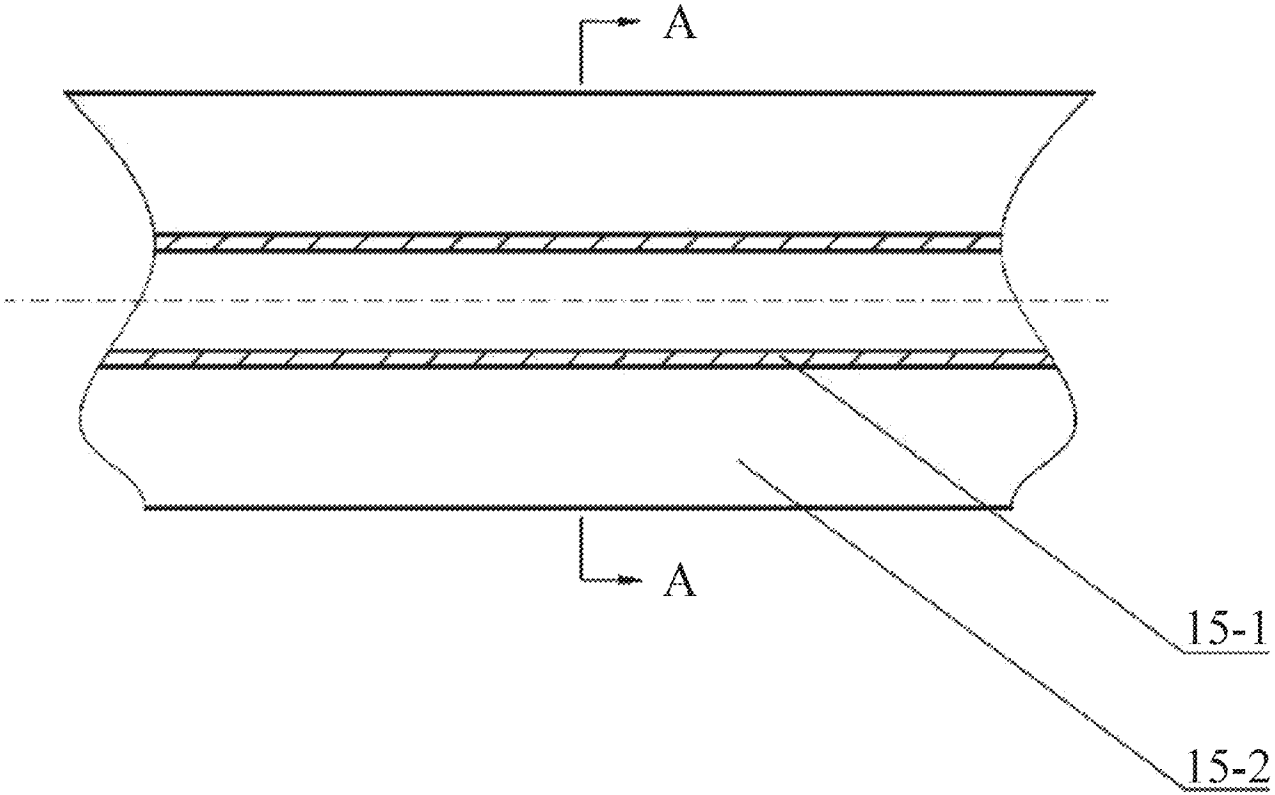
FIG. 3A is a side view of a gasification device and FIG. 3B is a cross-sectional view taken along line A-A of FIG. 3A as described in the disclosure.
Figure 3B:
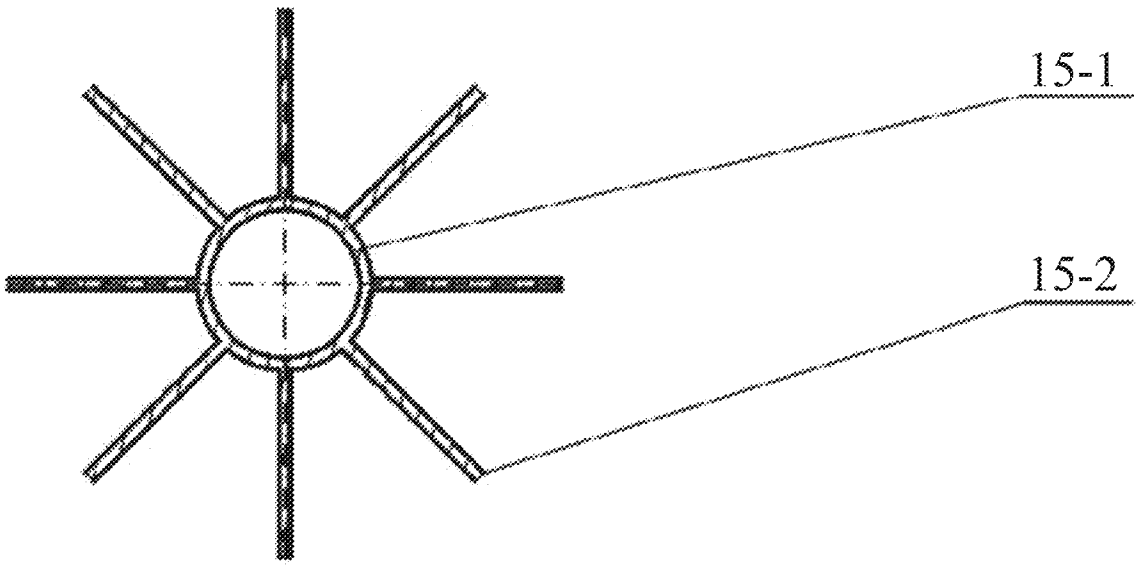

As shown in FIG. 3, the gasification device 15 comprises a gasification tube 15-1 and a plurality of heat dissipation fins 15-2. Both ends of the gasification tube 15-1 are connected to the first pipeline, and the heat dissipating fins 15-2 are radially disposed on the outer wall of the gasification tube 15-1. The heat dissipating fins 15-2 increase the surface area and improve the gasification efficiency of the liquid nitrogen.

As shown in FIG. 1, the rotatable support 7 is disposed on the vehicle frame 1, and the folding crane 3 is fixed on the rotatable support and is capable of rotation on the horizontal surface of the rotatable support 7.

As shown in FIG. 1, the folding arm 3 is disposed above the liquid nitrogen storage tank 2. The folding arm 3 comprises a plurality of mutually connected folding arms that are folded when not in use to save the space, and the folding arms are extended to a desired length in use.

As shown in FIG. 1, one end of the water delivery pipeline 11 is connected to the water pipe adapter 12, and the water pipe adapter 12 is connected to an external water source. The water source, optionally, has a pressure of 0.8 to 1.0 megapascal or comprises a water-based fire extinguishing agent with 3% F-500 and 1 to 3% ofFireAde2000, a 6% aqueous film-forming foam extinguishing agent, 1% Class A foam fire extinguishing agent, or a chemical decontaminant.

Figure 4:
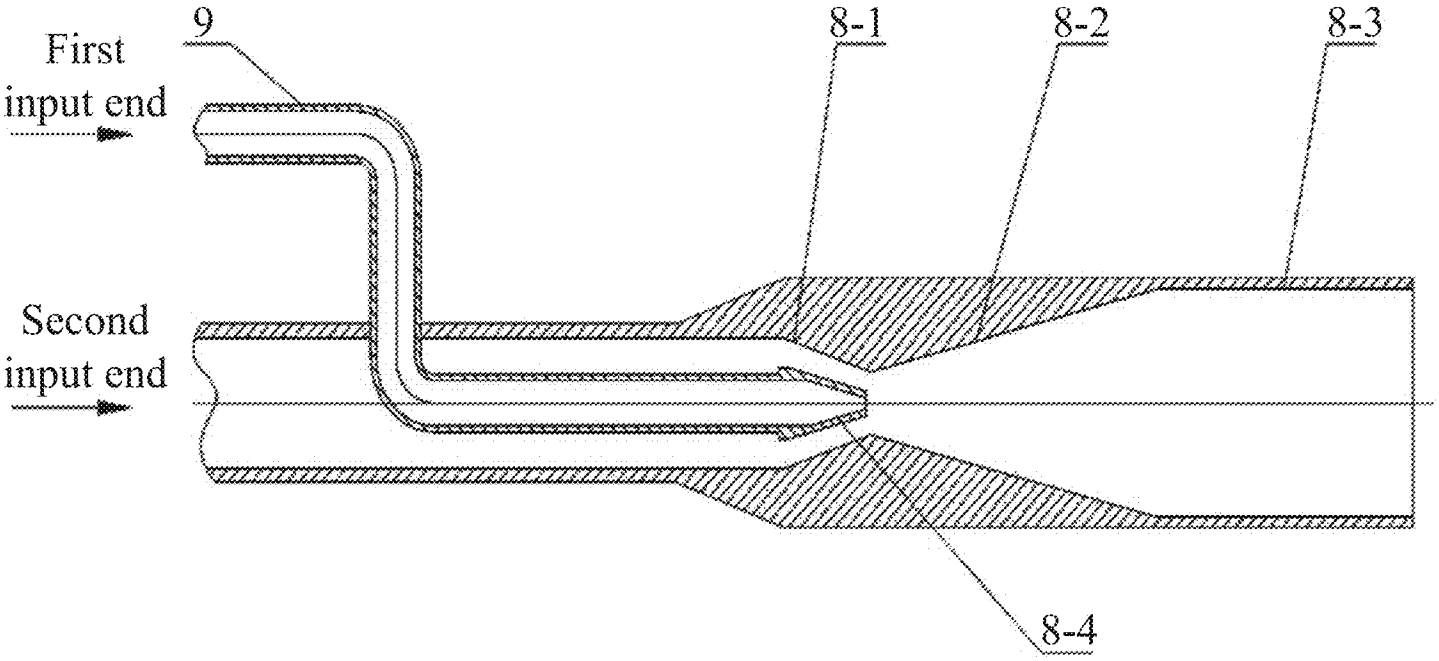
FIG. 4 is a cross-sectional view of a liquid nitrogen spray gun as described in the disclosure.

As shown in FIG. 4, the mixed spray gun 8 is disposed on the front end of the folding crane 3 and can approach to the fire source closely by horizontal rotation and pitch injection in the three-dimensional space of the folding crane 3. The mixed spray gun 8 comprises a first input end, a second input end, a liquid nitrogen nozzle 8-4, and a spray pipe. The spray pipe comprises a contraction section 8-1, an expansion section 8-2, and an acceleration section 8-3 along a direction from the contraction section to the acceleration section.

Along the direction from the contraction section to the acceleration section, the inner diameter of the contraction section 8-1 decreases, and the inner diameter of the expansion section 8-2 increases. The inner diameter of the acceleration section 8-3 is constant and equal to the outlet diameter of the expansion section 8-2. The liquid nitrogen nozzle communicates with the first input end and is disposed on the axial line of the contraction section 8-1; the outlet of the liquid nitrogen nozzle 8-4 is coaxial with the outlet of the contraction section 8-1. The inlet of the second input end is connected to the water pipe adapter 12 and the outlet of the second input end communicates with the contraction section 8-1.

The method of mixing the liquid nitrogen with water to produce an atomized jet fluid is implemented as follows: the water pipe adapter 12 provides water having a pressure of 0.8 to 1.0 megapascal, water-based fire extinguishing agent or chemical decontaminating agent. The liquid enters the mixed spray gun 8 and flows through the contraction section 8-1 and the expansion section 8-2 and is ejected from the acceleration section 8-3. The liquid nitrogen from the liquid nitrogen storage tank 2 having a pressure of 1.2 to 1.6 megapascal is injected through the liquid nitrogen nozzle 8-4 and mixed with the water, water fire extinguishing agent or chemical decontamination solution in the contraction section 8-1 of the mixed spray gun 8 to form a liquid nitrogen jet. The liquid nitrogen jet collides with the water fluid and ruptures to yield a plurality of liquid nitrogen beads. The liquid nitrogen beads absorb heat, vaporize and expand in the expansion section 8-2. After the atomized jet fluid enters the acceleration section 8-3, the compressed nitrogen gas continues to expand under the pressure difference between the inside and the outside of the mixed spray gun 8. The mixed fluid is accelerated again due to the pressure difference. The pressure of the nitrogen at the outlet of the mixed spray gun 8 is equal to the external atmospheric pressure. Thus, the water, the water-based fire extinguishing agent or the chemical decontaminant obtains the energy of the compressed nitrogen gas to be ejected from the mixed spray gun 8 in the form of an atomized fluid jet with a relatively high speed.

For example, when the water flow rate of the mixed spray gun is set as 60 L/s, the flow rate of the liquid nitrogen is controlled by the electric valve 14-4 to be 3 kg/s, amd the mixed spray gun 8 emits an ultra-fine water mist jet having an average particle diameter of about 200 μm and a jet velocity of 80 to 100 m/s. This ultra-fine water mist jet is used for rapid smoke and temperature cooling and suppressing deflagration and detonation. When the electric valve 14-4 controls the flow rate of the liquid nitrogen to 2 kg/s, the mixed spray gun 8 emits a high-temperature spray of a water-based fire extinguishing agent having an average particle diameter of about 400 to 500 μm, and the outlet flow rate can reach 60 to 80 m/s. Changing the flow rate of the liquid nitrogen can eject different particle diameters of water mists sprayed from the mixed spray gun 8.

As shown in FIG. 1, the liquid nitrogen spray gun 13 is disposed on each side of the vehicle frame 1. The inlet end of the liquid nitrogen spray gun 13 is connected to the liquid nitrogen storage tank 2 through the second pipeline having a length of 50 to 80 m. The liquid nitrogen sprayed from the liquid nitrogen spray gun 13 is used to extinguish a fire that cannot be extinguished by water.

The electric valves are disposed on the liquid nitrogen conveying pipeline 9 and the water delivery pipeline:

(1) a first electric valve 14-1 disposed on the first pipeline;
(2) a second electric valve 14-2 disposed on the liquid nitrogen conveying pipeline of the liquid nitrogen spray gun 13;
(3) a third electric valve 14-3 disposed on the water delivery pipeline of the water pipe adapter 12;
(4) a fourth electric valve 14-4 disposed on the liquid nitrogen conveying pipeline of the mixed spray gun 8.

The first electric valve 14-1 and the pressure sensor 6 control the flow rate of the liquid nitrogen entering the liquid nitrogenizing device 15; the second electric valve 14-2 controls the flow rate of the liquid nitrogen sprayed from the liquid nitrogen spray gun 13 to be between 1 and 4 kg/s; the third electric valve 14-3 controls the pressure of water, water-based fire extinguishing agent or chemical decontaminating agent from outside to be within 0.8 to 1.0 megapascal; and the fourth electric valve 14-4 controls the flow rate of the liquid nitrogen entering the mixed spray gun 8 so that the mass ratio of the liquid nitrogen to the water is 1:20-40.

Liquid nitrogen has a temperature of −196° C. under normal pressure, and 1 L of liquid nitrogen can produce 696 L of pure nitrogen gas at 21° C. Specifically, closing the relief valve 10 and opening the electric valve 14-1. A portion of the liquid nitrogen from the bottom of the liquid nitrogen storage tank 2 through the first pipeline enters the gasification device 15 through the electric valve 14-1 by gravity. The liquid nitrogen absorbs external heat and is vaporized into nitrogen gas, and the pressure in the gasification device 15 rises due to the increase of the volume of nitrogen gas. Nitrogen gas is introduced into the tank from the second opening of the tank through the liquid nitrogen conveying pipeline to pressurize the liquid nitrogen in the tank. The pressure sensor 6 controls the flow rate of the liquid nitrogen into the liquid nitrogen gasifier 15 through the electric valve 14-1 to ensure that the pressure in the tank is between 1.2 and 1.6 megapascal. When the pressure value in the tank is higher than 1.6 megapascal, the safety valve 4 opens to release pressure, and the pressure value in the tank is kept stable. The pressure sensor 6 lowers the flow rate of the liquid nitrogen entering the liquid nitrogen gasifier 15 through the electric valve 14-1, or directly closes the electric valve 14-1 to restore the pressure inside the tank. When the electric valve 14-2 that outputs liquid nitrogen is opened, the liquid nitrogen in the tank is output to the outside of the tank at a pressure of 1.2 to 1.6 megapascal. The electric valve 14-2 controls the flow rate of liquid nitrogen to be between 1 and 4 kg/s, which can be adjusted as needed.

Example 1

As shown in FIG. 1, the fire engine with liquid nitrogen as the injection power comprises a vehicle frame 1, a liquid nitrogen storage tank 2, a folding crane 3, a safety valve 4, a liquid level gauge 5, a pressure sensor 6, a rotatable support 7, a mixed spray gun 8, a liquid nitrogen conveying pipeline 9, a relief valve 10, a water delivery pipeline 11, a water pipe adapter 12, a liquid nitrogen spray gun 13, a first electric valve 14-1, a second electric valve 14-2, a third electric valve 14-3, and a gasification device 15. The liquid nitrogen storage tank 2 is mounted on the vehicle frame 1, and the rotatable support 7 and the folding crane 3 are disposed on one side of the liquid nitrogen storage tank 2, and the water pipe adapter 12 is disposed below the rotatable support 7. A mixed spray gun 8 is mounted on the upper end of the folding crane 3, and the liquid nitrogen nozzle 8-4 in the mixed spray gun 8 is connected to the liquid nitrogen storage tank 2 through the liquid nitrogen conveying pipeline 9 and the electric valve 14-2. The water inlet end of the mixed spray gun 8 is connected to the water pipe adapter 12 through the water delivery pipeline 11 and the electric valve 14-3. Simultaneously open the second electric valve 14-2 and the third electric valve 14-3, the liquid nitrogen from the liquid nitrogen storage tank 2 having a pressure of 1.2 to 1.6 megapascal and the water or water-based fire extinguishing agent from the external water tank having a pressure of 0.8 to 1.0 megapascal enter the mixed spray gun 8 and produce a "gas-water" mixed fluid that is ejected at a rate of 60 to 80 m/s. The folding crane 3 is unfolded and rotated to align the mixed spray gun 8 with the fire source to extinguish the fire with a mist jet of rapid spray water or water fire extinguishing agent.

The implementation method will be further explained by taking the fire of the petrochemical plant as an example. The fire engine with liquid nitrogen as the extinguishing agent is supported by a water tank fire engine. When the folding crane 3 is fully opened, the position of the mixed spray gun 8 can be up to 32 meters, or the mixed spray gun 8 can be extended in a horizontal front direction to an appropriate position near the fire source. The third electric valve 14-3 and the fourth electric valve 14-4 are opened, and the water pipe adapter 12 inputs water containing 3% F-500 fire extinguishing agent into the mixed spray gun 8 through the water delivery pipeline 11. The liquid nitrogen enters the liquid nitrogen nozzle 8-4 of the mixed spray gun 8 through the liquid nitrogen conveying pipeline 9 via the fourth electric valve 14-4. The liquid nitrogen and the water comprising 3% F-500 fire extinguishing agent are mixed in the mixed spray gun 8 and then ejected at a high speed in the form of a misty fluid. The F-500 fire extinguishing agent has rapid cooling ability, which can combine with water molecules to encapsulate flammable liquid molecules to prevent it from burning, so as to quickly extinguish the flame.

Example 2

Take the fire fighting in a clothing warehouse as an example. As shown in FIG. 1, the fire engine comprises a liquid nitrogen liquid nitrogen spray gun 13 connected to the outlet of the liquid nitrogen storage tank 2 through the second electric valve 14-2 and the liquid nitrogen conveying pipeline 9. The liquid nitrogen conveying pipeline 9 has a length of 80 m. In use, pull out the liquid nitrogen spray gun 13, shut down all doors and windows of the garment warehouse, open the second electric valve 14-2, and the firefighters wearing the positive pressure breathing apparatus take the liquid nitrogen spray gun 13 into the warehouse, or spray the liquid nitrogen fire extinguishing agent into the warehouse from the crack of the door. All the open flames and smoldering fires are extinguished in the warehouse when the oxygen content in the air drops below 10%. A fire engine carrying 5 tons of liquid nitrogen can extinguish a fire in a clothing warehouse with the volume of no more than 4000 $m^3$.

Example 3

In the case of the leakage of liquid chlorine, yellow-green chlorine gas is produced, and the density of the chlorine gas is 3.21 $kg/m^3$ at normal temperature, which is close to the ground and spreads downstream with the wind. Under the support of a water tank fire engine, the fire engine in the example stays about 30 to 40 m from the liquid chlorine leakage position in the upwind or crosswind direction. The folding crane 3 is opened, and the mixed spray gun 8 is extended to face the liquid chlorine leakage position. Open the third electric valve 14-3 and the fourth electric valve 14-4, and the decontamination solution containing dissolved sodium carbonate enters the mixed spray gun 8 via the water pipe adapter 12 and the water delivery pipeline 11. The liquid nitrogen enters the liquid nitrogen nozzle 8-4 of the mixed spray gun 8 via the fourth electric valve 14-4 and the liquid nitrogen conveying pipeline 9. The liquid nitrogen and the decontamination solution containing dissolved sodium carbonate are mixed in the mixed spray gun 8, and then sprayed at a high speed in a misty fluid and blended with the leaked chlorine gas. Sodium carbonate reacts with the chlorine gas to form sodium chloride to release carbon dioxide. The water mist absorbs the chlorine gas to form hypochlorous acid falling to the ground, so that the leaked chlorine gas is diluted.

It will be obvious to those skilled in the art that changes and modifications may be made, and therefore, the aim in the appended claims is to cover all such changes and modifications.

What is claimed is:

1. A device, comprising:

a vehicle frame;

a liquid nitrogen storage tank comprising a first opening and a second opening;

a liquid nitrogen conveying pipeline;

a gasification device;

a plurality of electric valves;

a water pipe adapter;

a liquid nitrogen spray gun comprising an input end; and a mixed spray gun comprising a first input end, a second input end, a liquid nitrogen nozzle, and a spray pipe;

wherein:

the liquid nitrogen storage tank is disposed on the vehicle frame; the second opening is disposed higher than the first opening relative to the gasification device;

the liquid nitrogen conveying pipeline comprises at least a first pipeline and a second pipeline; the first pipeline connects the first opening of the liquid nitrogen storage tank, the gasification device, and the second opening of the liquid nitrogen storage tank sequentially in that order; the second pipeline connects the liquid nitrogen storage tank, the input end of the liquid nitrogen spray gun, and the first input end of the mixed spray gun sequentially in that order;

the spray pipe comprises a contraction section, an expansion section, and an acceleration section which are connected to one another in that order; along a direction from the contraction section to the acceleration section, an inner diameter of the contraction section decreases, and an inner diameter of the expansion section increases; an inner diameter of the acceleration section is constant and equal to an outlet diameter of the expansion section;

the liquid nitrogen nozzle communicates with the first input end and is disposed on an axial line of the contraction section; an outlet of the liquid nitrogen nozzle is coaxial with an outlet of the contraction section; an inlet of the second input end is connected to the water pipe adapter and an outlet of the second input end communicates with the contraction section;

the water pipe adapter is connected to the inlet of the second input end via a water delivery pipeline; and the plurality of electric valves is disposed on the liquid nitrogen conveying pipeline and the water delivery pipeline.

2. The device of claim 1, wherein the gasification device comprises a gasification tube and a plurality of heat dissipating fins; an inlet of the gasification tube is connected to the first pipeline, and an outlet of the gasification tube is connected to the second opening of the liquid nitrogen storage tank via the first pipeline; and the plurality of heat dissipating fins is radially disposed on an outer wall of the gasification tube.

3. The device of claim 1, wherein the plurality of electric valves comprises a fourth electric valve disposed on the second pipeline connected to the mixed spray gun; and the fourth electric valve is configured to control a mass ratio of the liquid nitrogen to water to be 1: 20-40.

4. The device of claim 1, wherein the liquid nitrogen storage tank comprises a housing, a liner, and a gap between the housing and the liner; the liner is disposed in the housing; the gap is dried and has a pressure of 0.001 to 0.005 Pa, and an outer surface of the liner is provided with a heat insulating material comprising a zirconia foil layer.

5. The device of claim 1, wherein the fire engine further comprises a folding crane and a rotatable support; the mixed spray gun is disposed on one end of the folding crane; and the folding crane is fixed on the rotatable support and is capable of rotation at 360°.

6. The device of claim 1, wherein the liquid nitrogen storage tank is equipped with a pressure sensor.

7. The device of claim 1, wherein the liquid nitrogen conveying pipeline further comprises a third pipeline and a relief valve disposed on the third pipeline.

8. The device of claim 3, wherein the plurality of electric valves comprises a first electric valve disposed on the first pipeline, a second electric valve disposed on the liquid nitrogen conveying pipeline connected to the liquid nitrogen spray gun; and a third electric valve disposed on the water delivery pipeline connected to the water pipe adapter.

* * * * *